United States Patent [19]

Tsukiji

[11] Patent Number: 4,674,470

[45] Date of Patent: Jun. 23, 1987

[54] GAS GUN WITH RADIALLY ENLARGEABLE O-RING

[75] Inventor: Megumi Tsukiji, Tokyo, Japan

[73] Assignee: Yugengaisha Asahi Shouji, Tokyo, Japan

[21] Appl. No.: 819,243

[22] Filed: Jan. 15, 1986

[30] Foreign Application Priority Data

Jan. 29, 1985 [JP] Japan ..... 60-14724

[51] Int. Cl.[4] ..... F41B 11/06

[52] U.S. Cl. ..... 124/74; 124/41 C; 124/50

[58] Field of Search ..... 124/41 R, 41 C, 49, 124/50, 51 R, 52, 53, 56, 65, 66, 67, 68, 73, 74, 75, 76, 77

[56] References Cited

U.S. PATENT DOCUMENTS

| | | | |
|---|---|---|---|
| 2,633,838 | 4/1953 | Seward | 124/67 |
| 2,938,513 | 5/1960 | Giss | 124/68 |
| 3,204,625 | 9/1965 | Shepherd | 124/74 |
| 3,233,600 | 2/1966 | Spack | 124/74 |
| 4,147,152 | 4/1979 | Fischer et al. | 124/74 X |
| 4,191,158 | 3/1980 | Curran | 124/76 |

FOREIGN PATENT DOCUMENTS

| | | | |
|---|---|---|---|
| 2321433 | 11/1974 | Fed. Rep. of Germany | 124/74 |
| 1128095 | 12/1984 | U.S.S.R. | 124/67 |

*Primary Examiner*—Richard T. Stouffer

*Attorney, Agent, or Firm*—Merchant, Gould, Smith, Edell, Welter & Schmidt

[57] ABSTRACT

A gas gun includes a chamber, a barrel, and a bullet charging member for introducing bullets into the chamber. An elastic O-ring is positioned between the barrel and the charging member. A stepped part is formed integrally with the chamber and permits radial expansion of the O-ring. When pressurized gas is introduced into the chamber, the O-ring is caused to advance to the stepped part of the chamber when urged by a bullet. The bullet is motivated by the pressurized gas. The O-ring thereby becomes radially enlarged such that the bullet passes through the O-ring and is expelled from the barrel.

4 Claims, 4 Drawing Figures

GAS GUN WITH RADIALLY ENLARGEABLE O-RING

This invention is related to a gun which causes a bullet to be shot by utilizing gas pressure, or more specifically, to cause bullets to be shot successively by means of gas pressure.

DESCRIPTION OF THE PRIOR ART

A variety of guns, which utilize bullets made of metal, plastic, etc., are available. However, almost all of them can fire only a single-shot and an example of a gun having a successive-shooting function is very rare.

SUMMMARY OF THE INVENTION

The first object of the invention is to offer a gun which is capable of causing bullets to be shot successively by means of gas pressure. The further object of the invention is to offer a gun which has simple structure and can shoot bullets steadily without experiencing failure. The other object is to offer a gun which uses relatively low pressure gas without danger of spontaneous discharge and which is suitable for application to sport or training. Another object is to offer a gun having a small number of parts, enabling the use of plastic molded parts for a major portion, ease of manufacture, and allowing large quantity production.

These and other objects have been attained by the apparatus which comprises a gun barrel which can move along its longitudinal axis within the barrel jacket and chamber, a strong spring or springs which allows the gun barrel to recoil, a bullet charging member which guides each spherical bullet into the chamber, a weak spring or springs which cause the charging member to proceed forward, an elastic O-ring placed between the front portion of the above member and rear portion of the gun barrel, a step member formed as an integral part of the chamber, and a passage to introduce gas when the trigger is pulled.

BRIEF DESCRIPTION OF THE DRAWINGS

Like reference characters designate like or corresponding parts throughout the several views, wherein.

DETAILED DESCRIPTION OF THE PREFERRED EMBODIMENTS

Figure 1:
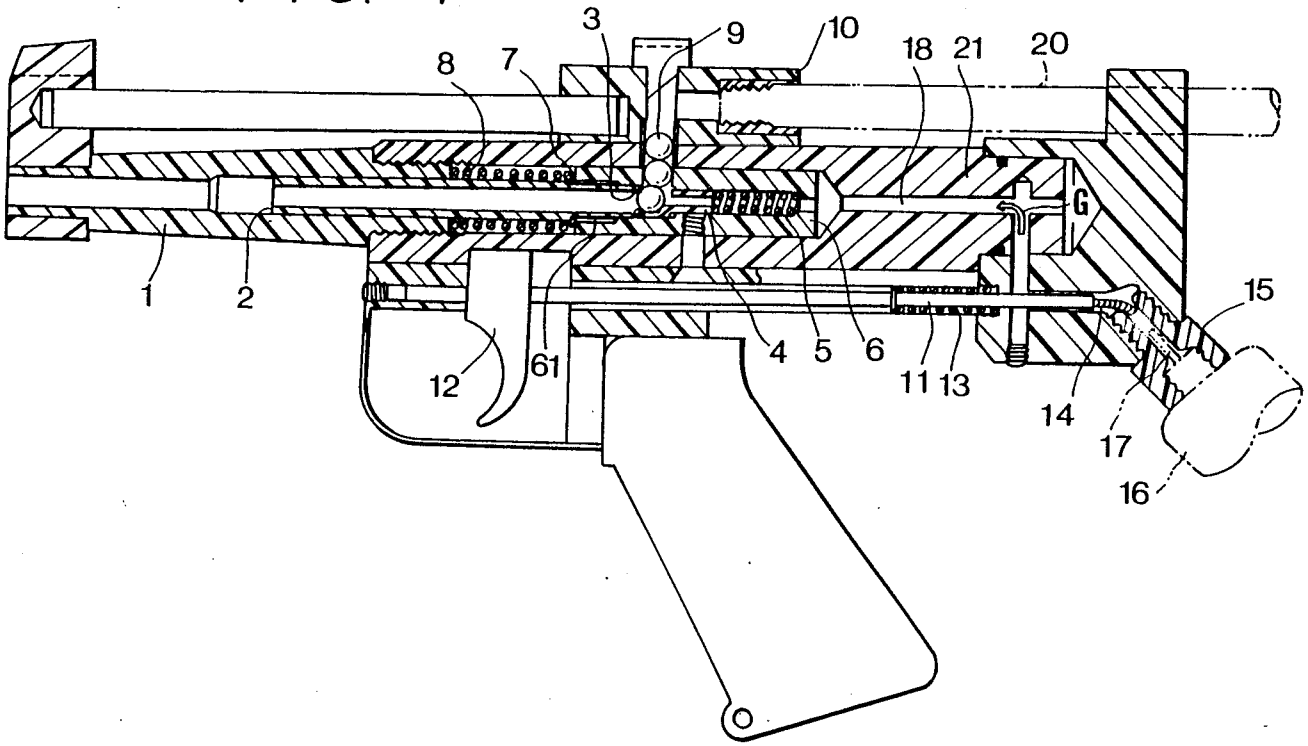
FIG. 1 is a sectional view indicating an exemplary embodiment of this invention.

In FIG. 1, numeral 1 is a barrel jacket, 2 is a gun barrel which can slide in the axial direction within the barrel jacket, 3 is an elastic O-ring proximate to the rear portion of the barrel, 4 is a bullet charging member located to the rear of the elastic O-ring 3, 5 is a weak spring which will act to move the member 4 forwards, 6 is a chamber to support those parts allowing axial direction movement, 7 is an E-ring attached to a part of the gun barrel 2, 8 is a strong spring located between the back end of the gun barrel jacket 1 and E-ring 7 and exerting an elastic force to the gun barrel 2 in the recoiling direction. The gun barrel jacket 1, gun barrel 2, bullet charging member 4, chamber 6, etc., can be made of plastic material as well as metal.

The spring 8 has larger resilience than that of spring 5, therefore under steady state conditions, the gun barrel 2 is urged to the position where E-ring 7 abuts the front end of the chamber 6, and consequently the O-ring 3 is also urged rearward. However, since the charging member 4 is being pushed by spring 5 and is moved forwards, O-ring 3 is confined between the gun barrel 2 and charging member 4.

The inside diameter of O-ring 3 is smaller than the outside diameter of the spherical bullet 9 under stationary condition; however, it can expand to be larger than the outer diameter of the bullet 9 because of the elasticity of the O-ring. A plurality of bullets 9 are fed continuously from the magazine attaching port 10, and arrive sequentially at charging member 4. As the upper side of the charging member 4 is opened, therefore, one bullet 9 can be advanced and placed to confront the O-ring 3. Magazine 20 which will be attached to the magazine attaching port 10 (attached with screw) is of a bottomed cylindrical type having an interior spring to feed the bullets. Therefore by attaching this magazine 20, a large supply of bullets can continuously be supplied while attaching port 10 remains air tight. Numeral 11 is a movable shaft prepared so that it can slide in the direction of its longitudinal axis. Shaft 11 is attached to trigger 12 at the front end. Numeral 13 is a spring to urge the movable shaft 11 forward toward its normal position. At the rear end of the movable shaft 11 a pushing member 14, being formed as a flexible coil, is attached and serves to control blowout of gas. For example, a gas cylinder 16, which is pressurized to relatively low pressure e.g. 7 $kg/cm^2$, is attached, by threading to the gas intake 15, and gas G is blown out when the gas blowout-valve 17 is pressed with pressing member 14. After gas G is blown out, it passes through the passage 18 prepared in the main body 21, and enters the chamber 6. Any gas can be placed in the gas cylinder 16; however, Freon TM gas, $CO_2$ etc., are preferable from the view point of handling and safety.

Figure 2:
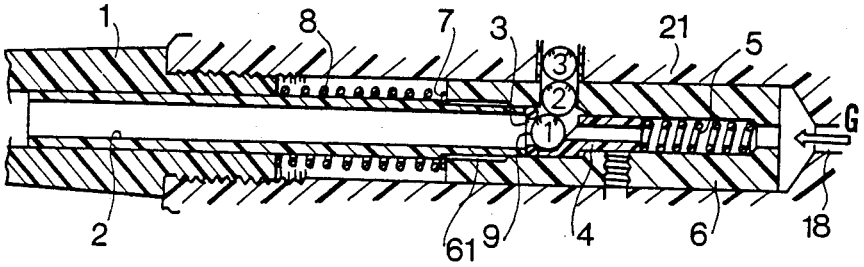
FIG. 2 is a sequential series of sectional views of the present invention so as to facilitate an operational explanation of the same.
Figure 2:
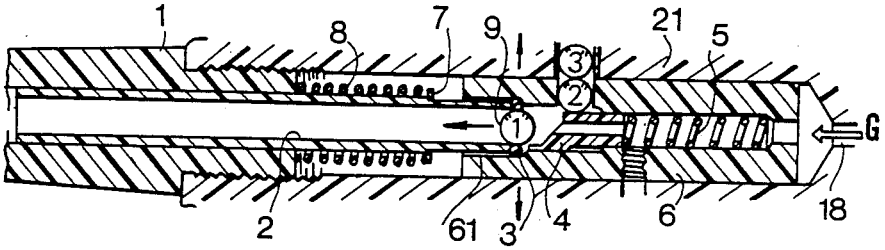
Figure 2:
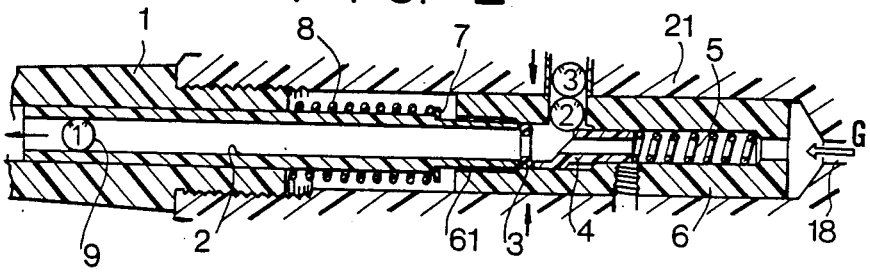

When gas G enters chamber 6, the bullet 9 occupying the lowest position receives the gas pressure from the back side, as shown in FIG. 2(*a*). In this state, however, the first bullet 9 cannot move because the internal diameter of the O-ring 3 is smaller than the diameter of the first bullet 9 (hereinafter referred to as "1"); therefore, the pressure at the back-side of the bullet "1" will rise. And when this gas pressure force exceeds the repulsion force of the spring 8, the bullet "1" will press against the O-ring 3, causing the O-ring 3 to press against the gun barrel 2, and this series of events causes the gun barrel 2 and O-ring 3 to advance.

When the O-ring advances, and eventually reaches the stepped part 61 of the chamber 6, the diameter of the O-ring 3 will be enlarged by the pressure exerted by the spherical surface of the bullet "1" until the internal diameter becomes equal to the external diameter of the bullet "1". This is the status shown in FIG. 2(*b*). At this stage, the spring 5 will be able to extend, and the charging member 4 will advance and prevent bullet "2" from falling down. Immediately after this, the bullet "1" will pass through the O-ring 3, and will be shot out through the interior of the gun barrel as shown in FIG. 2(*c*).

When the bullet "1" is shot out, the O-ring 3 will reduce its diameter due to its own elasticity. At the same time the force driving the gun barrel to advance is significantly reduced and the gun barrel 2 will be retracted by the force of the spring 8. The O-ring and charging member 4 will also retract, and return to the status of FIG. 2(*a*). Accompanied with this operation, the next bullet "2" will fall down to the area adjoining the O-ring 3 within the charging member 4. The trigger 12 will have been returned to the original position by this time, and when the blowing out of gas G is stopped, the shooting sequence will be completed by having fired a single shot; however, when the trigger 12 is continuously kept pulled, gas G is blowing out continuously, causing repetition of the above operation and the continuous shooting of bullets 9 in the sequence of "2", "3", etc. will be the result.

The structure is not limited to the example as stated above, but rather any valve structure which blows out gas G when the trigger 12 is pulled, can be adopted.

The muzzle velocity of the bullet 9 can be adjusted as desired by changing the pressure of gas G and the force of the spring 8, and the bullet 9 can be fired with more energy when a stronger spring 8 as well as a higher gas pressure G are adopted.

I claim:

1. A gas gun for shooting a bullet by utilizing gas pressure, comprising:

(a) a gun barrel, the barrel having a longitudinal axis;

(b) a jacket, the jacket longitudinally surrounding the barrel such that the barrel can move axially within the jacket;

(c) a chamber;

(d) a relatively strong spring, the spring tending to urge the barrel within the jacket;

(e) a bullet charging member, the bullet charging member adapted to include a supply of bullets and to urge the bullets in one-by-one sequence into the chamber;

(f) a second spring relatively weaker than said strong spring, the weak spring causing the charging member to advance towards the barrel;

(g) an elastic O-ring, the O-ring residing between the charging member and the gun barrel;

(h) a stepped part, the stepped part being formed integrally with the chamber, the stepped part permitting radial expansion of the O-ring;

(i) a trigger; and (j) a gas passage, the gas passage being connected to a source of pressurized gas and introducing gas from that source into the chamber when the trigger is pulled, thereby causing the O-ring to advance to the stepped part of the chamber when so urged by a bullet, the bullet being motivated by gas pressure from the gas, the O-ring thereby becoming radially enlarged such that the bullet passes through the O-ring and is expelled from the barrel.

2. The gas gun of claim 1 wherein the gun barrel is composed of a synthetic plastic material.

3. The gas gun of claim 1 wherein the bullet charging member is composed of a synthetic plastic material.

4. The gas gun of claim 1 wherein the gas utilized for propelling the bullet is a fluorcarbon.

* * * * *